United States Patent [19]

Chadshay

[11] 4,368,031

[45] Jan. 11, 1983

[54] STATIONARY FLAME SCANNER FOR TILTING BURNER

[75] Inventor: Roman Chadshay, Windsor, Conn.

[73] Assignee: Combustion Engineering, Inc., Windsor, Conn.

[21] Appl. No.: 167,976

[22] Filed: Jul. 14, 1980

[51] Int. Cl.[3] ..... F23N 5/08

[52] U.S. Cl. ..... 431/79; 431/175; 110/185

[58] Field of Search ..... 431/13, 75, 79, 175; 110/261-265, 185; 122/235 B; 307/117; 340/577, 578; 250/554, 372

[56] References Cited

U.S. PATENT DOCUMENTS

| | | | |
|---|---|---|---|
| 2,292,243 | 8/1942 | Schwartz | 110/261 |
| 2,306,073 | 12/1942 | Metcalf | 431/79 |
| 3,216,477 | 11/1965 | Devine | 431/79 |
| 3,241,595 | 3/1966 | Gilbert | 431/23 |
| 3,689,773 | 9/1972 | Wheeler | 250/554 |
| 4,051,375 | 9/1977 | Schuetz et al. | 250/372 |
| 4,168,785 | 9/1979 | Gabler et al. | 122/235 B |

*Primary Examiner*—Samuel Scott
*Assistant Examiner*—Lee E. Barrett
*Attorney, Agent, or Firm*—William W. Habelt

[57] ABSTRACT

A flame monitoring system for use on the furnace (10) of a vapor generator (2) employing tiltable burners (14) and particularly on a furnace equipped with tilting burners arranged in accord with the tangential firing method. Each burner is provided with its own individual scanner. Each scanner (20) is disposed to sight transversely across the base (30) of the flame (18) emanating from its associated burner (14). A plurality of at least three light transmission tubes (26) are stationarily mounted within each scanner head (24) with at least one tube (26A) mounted to sight at an upward acute angle across the flame, at least one other tube (26B) mounted to sight horizontally across the flame, and at least a third tube (26C) mounted to sight at a downward acute angle across the flame. A separate fire ball scanner (60) is mounted in the waterwall and aimed to sight at the center of the furnace (10) to monitor the fire ball (50) formed therein by the flames (18) emanating from the individual burners (14).

5 Claims, 10 Drawing Figures

STATIONARY FLAME SCANNER FOR TILTING BURNER

BACKGROUND OF THE INVENTION

The present invention relates to flame monitoring systems for vapor generators of the type having a furnace equipped with tilting burners. More particularly, the invention relates to a scanner system for detecting the presence of flame at each of the individually tilting burners in tangentially-fired boilers.

In the operation of a vapor generator there exists the danger of emitting fuel to the burners and thence into the furnace combustion chamber when there is no flame in which to provide ignition energy to ignite and burn the fuel. This condition results in a creation of a furnace atmosphere which is highly explosive. To ensure safe operation of the furnace, it is customary to provide some means of monitoring the furnace chamber to detect the presence of flame therein so that the supply of fuel to the furnace occurs only when the flame is present, thereby preventing the establishment of an explosive atmosphere within the furnace chamber.

One common method of firing fossil fuels, such as coal, oil or natural gas, in a furnace of a vapor generating boiler is known as tangential firing. In this method, fuel and combustion air are introduced into the furnace through burners, often termed fuel admission assemblies, located in the corners of the furnace alternatively stacked between air admission assemblies in a vertical array, termed windbox, of typically three or more burners per corner. The fuel and air streams discharging from the burners in the air admission assemblies respectively are aimed tangentially to an imaginary circle about the center of the furnace chamber. This creates a fire ball in the middle of the furnace chamber which serves as a continuous source of ignition for the incoming fuel. More specifically, a flame is established in one corner which in turn supplies the required ignition energy to stabilize the flame emanating from the corner downstream and laterally adjacent to it.

A distinct advantage of the tangential firing concept is that a wide range of control of steam temperature can be obtained by tilting in unison the nozzle tips of the burners and the air admission assemblies of the corner windboxes upward or downward. By so doing, the fireball is physically raised or lowered within the furnace so as to increase or decrease the heat absorption from the furnace water walls thereby effecting wide range control over the temperature of the combustion gases leaving the combustion zone and passing over downstream superheat and reheat surface. By tilting upward as load decreases, low load operation can be achieved while holding the overall cycle efficiency and maintaining better operation of the turbine. Additionally, the vertical adjustability of the burner and air admission assembly nozzle tips permits the operator of the furnace to compensate the changes in heat absorption within a furnace water wall resulting from fuel variation, and in particular, for the variations in the amount of slagging of the furnace water wall when coal is fired within the furnace.

In a furnace employing the tilting tangential firing system, it is desirable to monitor not only the fireball formed in the middle of the furnace chamber but also to monitor the flames of the individual corner burners to detect the existence of the ignition of the fuel emanating from each of the individual burners. A problem unique to furnaces equipped with tilting burners is that the flame emanating from the individual corner burners moves vertically as the burners are tilted upward or downward for steam temperature control. Thus, one must provide a flame scanner which is capable of viewing the individual flame emanating from a burner over the entire range of burner tilt while at the same time ensuring that the flame scanner has a view restricted as to view only the flame emanating from the burner with which it is associated and not the fireball or the flames of neighboring burners.

One common method of addressing the above-mentioned problem employs a plurality of flame scanners, one per burner, each mounted in the corner windboxes and aligned to sight through the flame emanating from its associated burner nozzle so as to view the region immediately in front of that burner. One example of such a flame monitoring system is discussed in detail in U.S. Pat. No. 3,241,595. The scanner sensor is mounted in the burner nozzle tip at the furnace end of the burner and is equipped with a flexible metallic sleeve through which wires from the scanner sensor bear back through the windbox to the scanner controls. The flexible metallic sleeve is provided to permit the scanner sensor to tilt with the nozzle tip in which it is mounted thereby allowing the scanner sensor to continuously view the flame emanating from the burner and only that burner. A problem associated with this arrangement is that the scanner sensor is exposed to direct radiation from the flame it views which may have a temperature in excess of 1400 C. Being exposed to such radiation would soon destroy the sensor unless the sensor is effectively cooled.

Another approach, as shown in U.S. Pat. No. 4,168,785, to solving the above-mentioned problem employs a plurality of flame scanners, one per burner, each positioned with a sensor viewing through a port in the furnace wall at a location adjacent its associated corner burner and aimed to sight transversely across the path of the flame emanating on that burner. Each scanner is pivotally mounted in a track outside the furnace so that the entire scanner assembly is tilted accordingly so as to permit the sensor to follow the flame emanating from its associated burner as the burner nozzle tips tilt upward or downward. Such a system has a distinct disadvantage having to provide a control system to ensure that each scanner follows its associated burner during the tilt maneuvers in order to prevent the scanner from losing sight of the flame and erroneously shutting down a properly-operating burner.

SUMMARY OF THE INVENTION

In order to overcome the aforementioned problems and to permit the scanning of each individual corner burner in a furnace designed for tilt burners, a plurality of stationary scanners, commensurate in number with the number of burners incorporated into the furnace, are positioned outside of the furnace at ports in the furnace walls in a location adjacent each burner. Each scanner comprises a scanner module, a scanner head, a plurality of at least three light transmission tubes, and a coolant sleeve enclosing the three light transmission tubes.

The scanner sensor module is located outside of the furnace in a hospitable environment where it is not exposed to direct radiation from the flame within the furnace. The scanner has a stationarily-mounted port in the furnace wall adjacent its associated burner. A plurality of at least three light transmission tubes are stationarily mounted within the scanner head so as to sight transversely across the base of the flame emanating from its associated burner. These light transmission tubes conduct light radiation generated by the flame emanating from the burner with which the scanner assembly is associated back to the scanner sensor module which, as mentioned previously, is exposed outside of the furnace.

In accordance with the invention, at least one of the light transmission tubes is disposed to sight upwardly at an acute angle into the furnace, at least one other of the light transmission tubes is exposed to sight horizontally into the furnace chamber, and at least one other of the light transmission tubes is disposed to sight downwardly at an acute angle into the furnace. Thus the necessity of tilting the scanner sensor to follow its associated burner is eliminated.

DESCRIPTION OF THE PREFERRED EMBODIMENT

Figure 1:
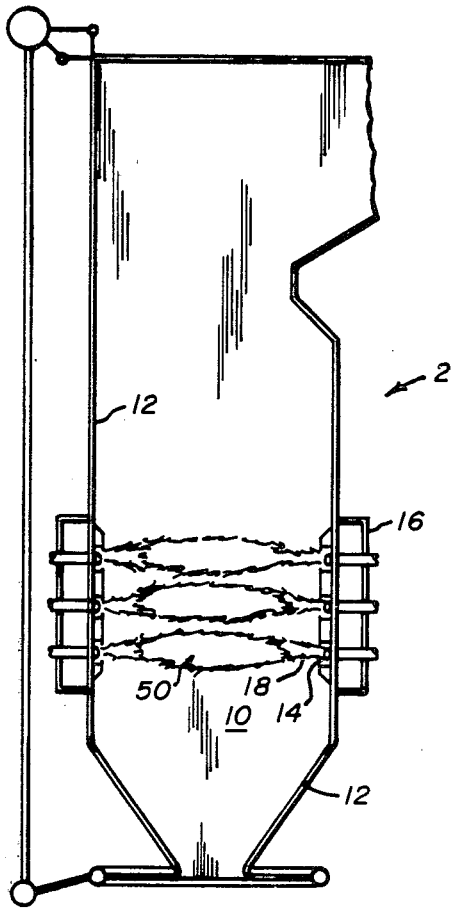
FIG. 1 is a diagrammatic illustration of a vapor generator of the type intended to employ the present invention.
Figure 2:
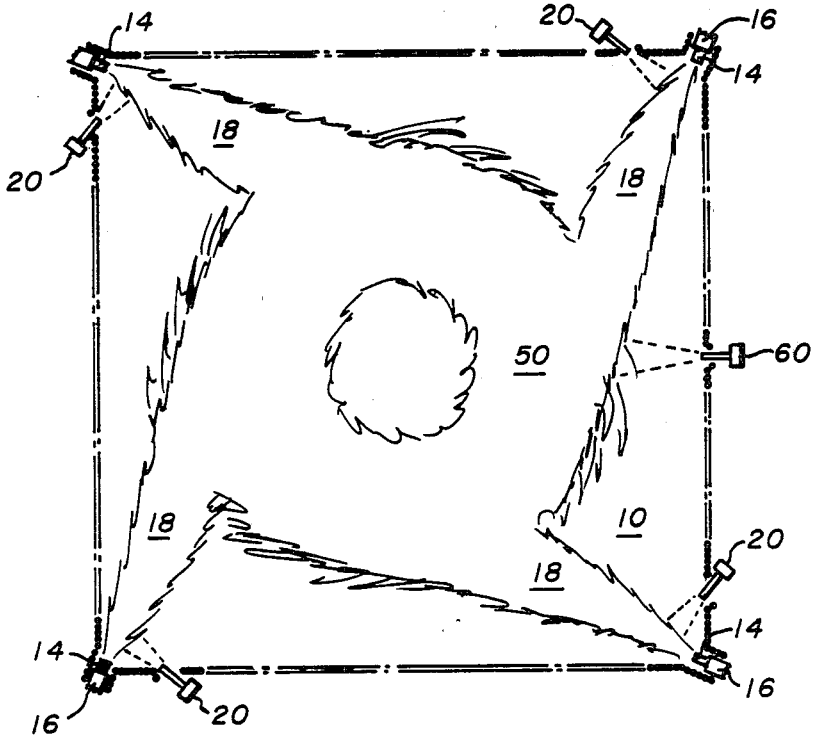
FIG. 2 is a diagrammatic plan view of one elevation of burners in a tangentially-fired furnace showing the typical position therein of the flame scanning apparatus of the present invention.

Referring now to the drawings there is shown in FIGS. 1 and 2 a vapor generator 2 having a furnace 10 of generally rectangular cross section enclosed by walls formed of closely-spaced, generally-upright vapor generating tubes 12 disposed around the circumference of the furnace. The vapor generating tubes 12 are interconnected in fluid communication whereby a vaporizable liquid, most commonly water, is transformed into vapor by the absorption of heat radiated from the combustion products generated in the furnace 10.

Fuel and combustion air are introduced into the furnace chamber 10 through burners 14 located in the corners of the furnace and alternately stacked between air admission assemblies in a vertical array, termed the windbox 16, of typically three or more burners per corner. In accordance with the well-known conventional firing method, the fuel and air streams discharging from the corner windboxes 16 are aimed tangentially to a imaginary circle about the center of the furnace 10. The fuel and air streams ignite shortly after entering the furnace 10, forming each elevation of burners, for flames 18, one emanating from each of the corner burners 14 to intersect within the furnace chamber 10 thereby forming a fireball 50 therein.

Figure 3:
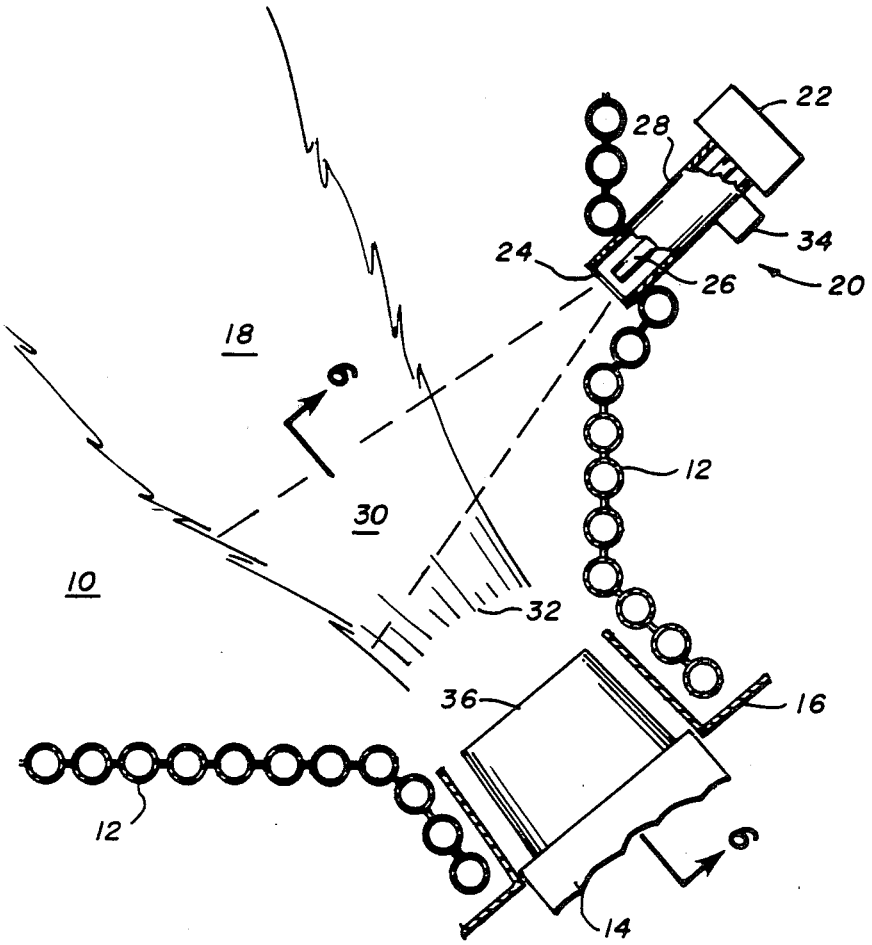
FIG. 3 is a horizontal cross-sectional view of one corner of the furnace shown in FIG. 2.

In utilizing the present invention, a plurality of stationary scanners 20, one per burner, are positioned outside the furnace chamber 10 at ports in the furnace walls 12 at a location adjacent each burner 14. As shown in FIG. 3, each scanner 20 comprises a scanner sensor module 22, a scanner head 24, a plurality of at least three light transmission tubes 26, and a cooling sleeve 28 enclosing the light transmission tubes 26.

In each corner burner 14, a scanner sensor module 22 is originally mounted outside the furnace chamber 10 in a hospitable environment where it is not exposed to the direct radiation from the flame within the furnace chamber. A scanner head 24 is stationarily mounted in a port in the furnace wall 12 at a location adjacent its associated burner 14. A plurality of at least three light transmission tubes 26 is stationarily mounted within the scanner head 24 to sight transversely across the base 30 of the flame 18 emanating from the burner 14. The base 30 of the flame 18 is defined as that region of the flame immediately upstream of the ignition front 32. The light transmission tubes 26 conduct light radiation emitted by the various species generated in the base 30 of the flame 18 with which the scanner 20 is associated back to the scanner sensor module 22 which, as mentioned previously, is disposed outside the furnace chamber 30 in a hospitable environment.

The light transmission tubes 26 are enclosed in a cooling sleeve 28 which extends between the center module 22 to the scanner head 24. Cooling air enters the cooling sleeve 28 through inlet 34 and is conducted therethrough along the light transmission tubes 26 thence through scanner head 24 into the furnace chamber 10. This cooling air prevents scanner head 24 in light transmission tubes 26 from overheating due to exposure to direct radiation from the hot combustion gases generated within the furnace chamber 10. Because the scanner sensor module 22 is not disposed so as to see direct radiation from the hot combustion gases, cooling problems are greatly simplified. In the present system, cooling air is needed only to cool the light transmission tubes 26 and the scanner head 24 enough to ensure the structural integrity, rather than to cool the scanner sensor itself to protect temperature sensing instrumentation contained therein.

A distinct advantage of the tangential firing concept lies in the ability to control steam temperature by raising or lowering the fire ball 50 in the furnace 10. The position of the fire ball 50 is altered by tilting the nozzle tips 36 of the corner burners 14 upward or downward from the horizontal thereby causing the flames 18 emanating from each of the corner burners 14 to be directed into the furnace 10 upwardly or downwardly at an acute angle with the horizontal of up to approximately 30 degrees.

As previously mentioned, it is imperative that each scanner continually view its associated flame while at the same time not viewing the flame emanating from adjacent burners of the same elevation or from burners either above or below it in the same corner or the fire ball itself. Accordingly, the angle of view of each scanner must be narrowly restricted to view only the flame emanating from the burner with which it is associated. Since the view of the scanner must be narrowly restricted, the scanners that are prior art would, if held stationary, lose view of the flame when the burner nozzle tips were tilted upward or downward in response to steam temperature control thereby resulting in erroneous call for burner shutdown. Consequently, the scanners of the prior art were designed to tilt with their associated burners. The present invention provides a stationary scanner which will continuously view the flame emanating from its associated burner through the entire range of burner tilt.

Figure 4:
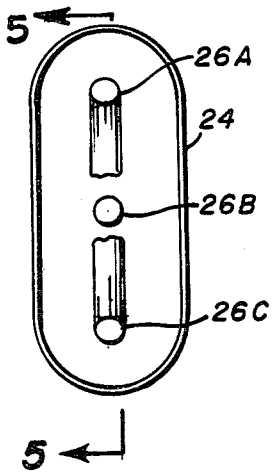
FIG. 4 is an end view looking from the furnace chamber into the head of the scanner assembly of the present invention.
Figure 5:
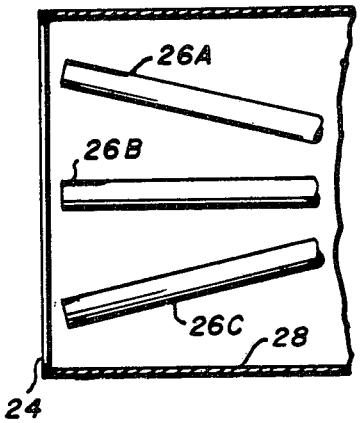
FIG. 5 is a side elevational view taken along line 5—5 of FIG. 3.

According to the present invention, a plurality of at least three light transmission tubes 26 are disposed within the scanner head, as shown in FIGS. 4 and 5, to view the flame emanating from its associated burner. At least one of the light transmission tubes 26A is mounted at a fixed upward angle to sight upwardly at an acute angle into the furnace chamber 10, at least one of the light transmission tubes 26B is mounted to sight horizontally into the furnace chamber 10, and at least one of the light transmission tubes 26C is mounted at a fixed downward angle to sight downwardly at an acute angle into the furnace chamber 10. In this manner, the stationary scanner will in effect be able to view the flame emanating from its associated corner burner with the entire range of burner tilt.

Figure 6A:
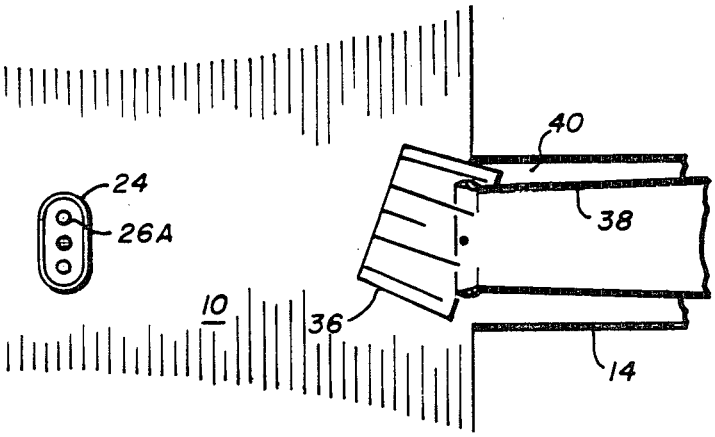
FIG. 6*a* is a side elevational view taken along line 6—6 of FIG. 3 showing the burner nozzle tip upwardly tilted.
Figure 6B:
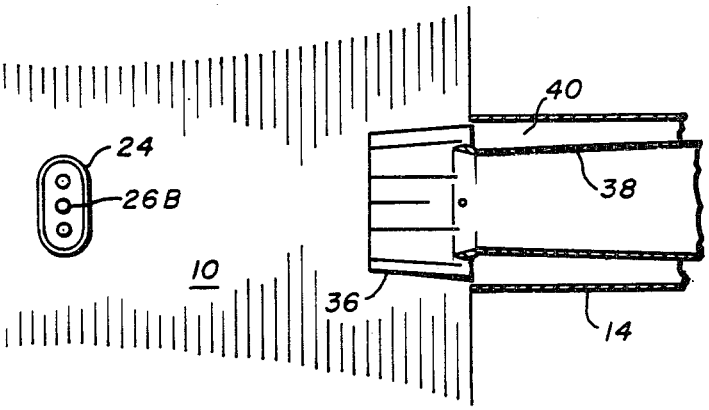
FIG. 6*b* is a side elevational view taken along line 6—6 of FIG. 3 showing the burner nozzle tip horizontally disposed.
Figure 6C:
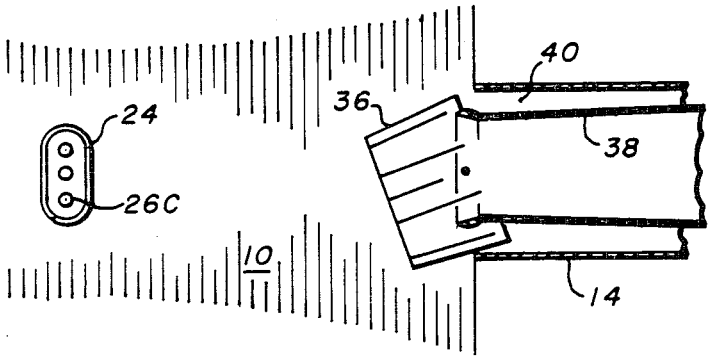
FIG. 6*c* is a side elevational view taken along line 6—6 of FIG. 3 showing the burner nozzle tip downwardly tilted.

This point is best illustrated with reference to FIGS. 6A, 6B, and 6C. Referring first to FIG. 6A, there is shown a typical coal-fired burner 14 with its nozzle tip tilted upward to direct the pulverized coal discharging from the coal pipe 38 in the combustion air passing through duct 40 surrounding coal pipe 38 into the furnace chamber 10 at an upward angle to the horizontal. The flame formed by the ignition of the coal and air stream discharging from the burner 14 through the upwardly-tilted nozzle 36 would be viewed by the scanner 20 through the upwardly-directed light transmission tube 26A. In this position, no light would be transmitted through tubes 26B and 26C because with the nozzle tip 36 upwardly tilted, tubes B and C would simply sight across the corner of the furnace chamber to the dark surface of the adjacent furnace bounding wall tubes.

When the burner nozzle tip 36 is disposed horizontally as shown in FIG. 26B, the flame formed from the ignition of the coal and air discharging from the furnace 14 would be viewed by the scanner 20 through horizontally-directed light transmission tube 26B. Similarly, when the burner nozzle tip 36 is tilted downward as shown in FIG. 5C, the flame formed upon ignition of the coal and air discharging from burner 14 downwardly into the furnace chamber 10 would be viewed by the scanner through the downwardly-directed light transmission tubes 26C.

The full range of burner tilt in a tangentially-fired furnace typically ranges from a downward angle of 30 degrees from the horizontal to an upward angle of 30 degrees from the horizontal. Accordingly, the plurality of light transmission tubes 26 within the scanner head 24 must be aligned so that a full tilt range of 60 degrees is continuously viewed. In the three tube embodiments illustrated in FIGS. 4 and 5, for example, the upwardly-directed light transmission tube 26A would be mounted to view the flame when the nozzle tip 36 was tilted upwardly at an angle of 10–30 degrees, the downwardly-directed light transmission tube 26C would be mounted to view the flame when the nozzle tip 36 was tilted downwardly at an angle of 10–30 degrees, and the horizontally-disposed light transmission tube 26C would view the flame with the nozzle tip 36 which is horizontally disposed or tilted at an angle of less than 10 degrees upwardly or downwardly.

The arrangement of three light transmission tubes, as shown in FIGS. 4 and 5, has particular applicability to coal-fired furnaces. In coal firing, a stable ignition front is readily established at a predictable point upstream of the nozzle tip 36. Thus, a single column of light transmission tubes 26 can be used without concern that the ignition front will move further out into the furnace away from the nozzle tip 36 or back toward the nozzle tip 36.

However, in an oil-fired furnace the ignition front commonly jumps around from right on the oil gun tip to a point several feet into the furnace depending upon various operating parameters including excess air and pressure drop across the oil gun tip. Consequently, one cannot predict exactly where you aim a single column of white transmission tubes to be assured of all reviewing the base of the flame. Accordingly, an arrangement of more than three light transmission tubes, as shown in FIG. 6, must be applied to oil-fired furnaces.

Figure 8:
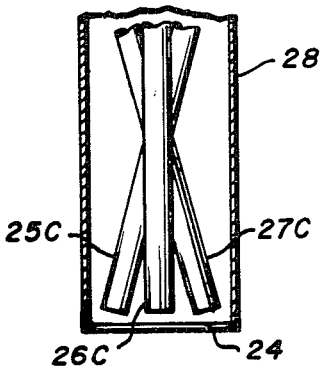
FIG. 8 is a side elevational view taken along line 8—8 of FIG. 7.
Figure 7:
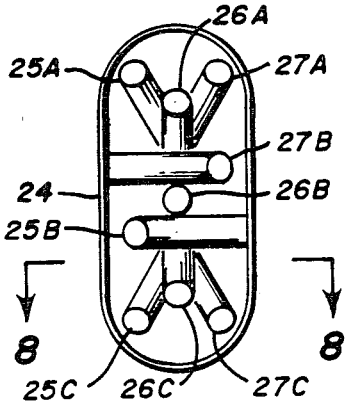
FIG. 7 is an end view looking from the furnace chamber into the head of an alternate embodiment of the scanner assembly of the present invention.

As shown in FIGS. 7 and 8, three columns of light transmission tubes 25, 26, and 27 of three light transmission tubes each are provided. Tubes 25A and 27A are monitored within the scanner head 24 at a fixed upward angle to sight upwardly into the furnace chamber 10 in a manner similar to the tube 26A. Tubes 25B and 27B are monitored to sight horizontally into the furnace chamber along with tube 26B. Tubes 25C and 27C are monitored within the scanner head 24 at a fixed downward angle to sight downwardly into the furnace chamber 10 in a manner similar to tube 26C. However, tubes 25A, B, and C are mounted so as to sight across the flame 18 in a direction away from the nozzle tip 36. Tubes 27A, B, and C are mounted so as to sight across the flame 18 in a direction toward the nozzle tip 36. In this manner, the base 30 of flame 18 will always be in view of one of the plurality of light transmission tubes 25, 26, and 27 even though the flame ignition front 32 may oscillate back and forth from the burner tip to a point several feet into the furnace.

As it is desirous to monitor the fire ball 50 formed at each burner elevation by the impingement of the individual flames 18 emanating from the corners of the furnace chamber 10, the present invention also contemplates locating an additional stationary scanner 60 as shown in FIG. 1 at a port formed in one of the furnace walls at a point midway between the corner burners thereof to view the fire ball 50. The fire ball scanner 60 would be of the same embodiment as scanner 20 as shown in FIGS. 4 and 5. That is, the fire ball scanner 60 would employ three light transmission tubes 26, the uppermost tube 26A being mounted within the scanner head at a fixed angle to sight upwardly at an acute angle into the furnace chamber 10, the middle tube 26B rigidly mounted to sight horizontally into the furnace chamber 10, and the lowermost tube 26C being mounted within the scanner head at a fixed angle to sight downwardly at an acute angle into the furnace chamber 10.

As the fire ball 50 moves upward or downward within the furnace in response to the tilting of the burner nozzle tips, the fire ball scanner 60 would continuously view the fire ball 50 in much the same manner as the individual flame scanner 20 monitored the flame emanating from their associated burner. That is, the fire ball scanner 60 would view a fire ball formed at an upward burner tilt through the uppermost light transmission tube 26A, a fire ball formed at the horizontal tilt to the middle light transmission tube 26B, and a fire ball formed at the downward burner tilt through the lowermost light transmission tube 26C.

In the preferred embodiment of the present invention, each light transmission tube 25, 26, 27 comprises a fiber optic bundle formed of two or more fiber optic strands. The use of fiber optic bundles facilitates the running of the light transmission tubes from the scanner head 24 back to the scanner sensing module 22 which is located outside the furnace chamber 10 in a more hospitable environment. Further, the use of a fiber optic bundle of at least two strands provides a form of redundancy for each light transmission tube. Thus, even if a bundle is damaged during installation or operation, the light transmission tube will still conduct light radiation to the scanner sensing module 22 so long as a single strand of fiber optic bundle is still functional.

Although the present invention has been described in detail with reference to a furnace employing tilting tangential burners, it is to be understood that the present invention has application to any furnace which employs tilting burners, whether or not the tilting burners are located within the furnace in accordance with the teachings of the tangential firing method.

I claim:

1. In a vapor generator having a furnace of generally rectangular cross section enclosed by walls formed of vapor generating tubes, a plurality of burners mounted in the furnace walls and operative to discharge a stream of fuel into the furnace, means operative to ignite the various streams of fuel discharging into the furnace thereby forming a plurality of individual flames with one flame emanating from each burner, and means operatively associated with the burners for altering the angle of discharge with respect to the horizontal of the stream of fuel discharging from the burners; a flame monitoring system having a plurality of flame scanner assemblies commensurate in number with the plurality of burners with one flame scanner assembly associated with each burner for monitoring the individual flames emanating from the burners; each flame scanner assembly comprising:

a. a scanner sensor module located outside of the furnace where it is not exposed to direct radiation from the flame emanating from the burner with which the flame scanner assembly is associated;

b. a scanner head stationarily mounted in a port in the furnace wall adjacent said associated burner;

c. a plurality of at least three light transmission tubes stationarily mounted within said scanner head so as to sight transversely across the flame emanating from said associated burner, at least one of said light transmission tubes stationarily mounted within said scanner head to sight upwardly at an acute angle into the furnace, at least one of said light transmission tubes stationarily mounted within said scanner head to sight horizontally into the furnace, and at least one of said light transmission tubes stationarily mounted within said scanner head to sight downwardly at an acute angle into the furnace, said light transmission tubes extending from said scanner head to said scanner sensor module thereby providing a path through which light radiation generated by the flame passes to said scanner sensor module; and d. a cooling sleeve enclosing said light transmission tubes, said cooling sleeve providing a conduit through which cooling air may be passed over said light transmission tubes and through said scanner head into the furnace.

2. A flame monitoring system as recited in claim 1 wherein each of said light transmission tubes is formed of a fiber optic material.

3. A flame monitoring system as recited in claim 2 wherein each of said light transmission tubes comprises a fiber optic bundle having at least two fiber optic threads per bundle.

4. In a vapor generator having a tangentially-fired furnace of generally rectangular cross section enclosed by walls formed of vapor generating tubes, a plurality of burners mounted in the corners of the furnace and operative to discharage a stream of fuel into the furnace tangent to an imaginary circle about the center of the furnace, means operative to ignite the various streams of fuel discharging into the furnace thereby forming a plurality of individual flames with one flame emanating from each burner, said individual flames impinging within the furnace to form a fire ball, and means operatively associated with the burners for alternating the angle of discharge with respect to the horizontal of the stream of fuel discharging from the burners thereby raising or lowering the fire ball within the furnace; a flame monitoring system having a plurality of flame scanner assemblies commensurate in number with the plurality of burners with one flame scanner assembly associated with each burner for mounting the individual flames emanating from the burners, each flame scanner assembly comprising:

a. a scanner sensor module located outside of the furnace where it is not exposed to direct radiation from the flame emanating from the burner with which the flame scanner assembly is associated;

b. a scanner head stationarily mounted in a port in the furnace wall adjacent said associated burner;

c. a plurality of at least three light transmission tubes stationarily mounted within said scanner head so as to sight transversely across the flame emanating from said associated burner, at least one of said light transmission tubes stationarily mounted within said scanner head to sight upwardly at an acute angle into the furnace, at least one of said light transmission tubes stationarily mounted within said scanner head to sight downwardly at an acute angle into the furnace, said light transmission tubes extending from said scanner head to said scanner sensor module thereby providing a path through which light radiation generated by the flame passes to said scanner sensor module; and d. a cooling sleeve enclosing said light transmission tubes, said cooling sleeve providing a conduit through which cooling air may be passed over said light transmission tubes and through said scanner head into the furnace.

5. A flame monitoring system as recited in claim 4 further including a fire ball scanner assembly for monitoring the fire ball formed in the center of the furnace; said fire ball scanner assembly comprising:

a. a scanner sensor module located outside of the furnace where it is not exposed to direct radiation from the fire ball;

b. a scanner head stationarily mounted in one wall of the furnace at a point approximately midway between the corner burners;

c. three light transmission tubes stationarily mounted in a vertical column within said scanner head so as to sight transversely across the flame emanating from said associated burner, the uppermost of said light transmission tubes stationarily mounted within said scanner head to sight upwardly at an acute angle into the furnace, the middle of said light transmission tubes stationarily mounted within said scanner head to sight horizontally into the furnace, and the lowermost of said light transmission tubes stationarily mounted within said scanner head to sight downwardly at an acute angle into the furnace, said light transmission tubes extending from said scanner head to said scanner sensor module thereby providing a path through which light radiation generated by the fire ball passes to said scanner sensor module; and d. a cooling sleeve enclosing said light transmission tubes, said cooling sleeve providing a conduit through which cooling air may be passed over said light transmission tubes and through said scanner head into the furnace.

* * * * *